United States Patent [19]

Samera, Jr.

[11] Patent Number: 4,728,289

[45] Date of Patent: Mar. 1, 1988

[54] AXIAL SEAL SYSTEM FOR ROTARY COMBUSTOR

[75] Inventor: Edward Samera, Jr., Orange, Calif.

[73] Assignee: Westinghouse Electric Corp., Pittsburgh, Pa.

[21] Appl. No.: 26,931

[22] Filed: Mar. 10, 1987

[51] Int. Cl.[4] ..... F27B 7/24; F27D 1/18; F26B 25/00

[52] U.S. Cl. ..... 432/115; 432/242; 227/152; 415/173 R; 34/242

[58] Field of Search ..... 432/115, 64, 242; 34/115, 242; 415/173 R; 277/152, 58

[56] References Cited

U.S. PATENT DOCUMENTS

| | | | |
|---|---|---|---|
| 2,459,850 | 1/1949 | Stine | 415/173 A |
| 3,012,765 | 12/1961 | Deussuer | 432/115 |
| 3,018,856 | 1/1962 | Lyon | 415/173 R |
| 3,822,651 | 7/1974 | Harris et al. . | |
| 3,836,324 | 9/1974 | Shaefer et al. | 432/115 |
| 4,066,024 | 1/1978 | O'Connor . | |
| 4,193,756 | 3/1980 | Leon | 432/115 |
| 4,226,584 | 10/1980 | Ishikawa . | |
| 4,283,064 | 8/1981 | Staab et al. | 227/152 |
| 4,295,824 | 10/1981 | Wens | 432/242 |
| 4,439,144 | 3/1984 | Mair | 34/242 |
| 4,457,520 | 7/1984 | Graachtrup | 432/242 |

*Primary Examiner*—Henry C. Yuen

[57] ABSTRACT

A rotary combustor includes a rotatable cylindrical drum having axial seals extending from the outer periphery of the drum, and sealing structures for forming passages for providing combustion fluids along portions of the rotatable cylindrical drum. Each sealing structure includes a movable shoe positioned along the periphery of a portion of the rotatable cylindrical drum, a support positioned at a predetermined distance from the axial seals along a portion of the periphery of the rotatable cylindrical drum, and first and second spring units coupled between the support and the movable shoe. The spring units urge the movable shoe into contact with at least one of the axial seals. As a result, an air seal is continuously provided between the axial seal and the movable shoe even though the rotary combustor expands and contracts with temperature.

17 Claims, 5 Drawing Figures

AXIAL SEAL SYSTEM FOR ROTARY COMBUSTOR

BACKGROUND OF THE INVENTION

1. Field of the Invention

The present invention is related to a rotary combustor for burning waste material (e.g., municipal solid waste material), and more particularly, to an axial seal system for defining separate passages for providing combustion air to selected portions along the periphery of the rotary combustor.

2. Description of the Related Art

Numerous types of systems have been developed for solid waste disposal. One type of system for solid waste disposal employs a rotary kiln or combustor formed by a plurality of pipes defining an inner cylindrical surface in which solid waste is burned. The cylinder is rotated about its axis while the solid waste is burned, and the pipes are interconnected to permit a coolant (i.e., water) to flow through the pipes. The water flows through the pipes and is circulated to a heat exchanger for a heat exchange operation, so that the heat created by the burning of the waste materials may be used in generating electricity. Examples of such rotary combustors are disclosed in U.S. Pat. No. 3,822,651 to Harris et al., U S. Pat. No. 4,066,024 to O'Connor and U.S. Pat. No. 4,226,584 to Ishikawa.

FIG. 1A is a schematic plan view of a rotary combustor and FIG. 1B is a schematic cross-sectional view taken along line B—B in FIG. 1A with the outer casing removed and showing connection of the rotary combustor to a heat exchanger and heat exchange fluid supply apparatus. Referring to FIGS. 1A and 1B, a rotary kiln or combustor 20 includes a combustion drum 22 formed by a plurality of tubes 24 which are interconnected to permit the flow of a heat exchange fluid (e.g., water) through the tubes 24. An outer casing 25 surrounds the combustion drum 22. A pair of cylindrical bands 26 are positioned about the periphery of the combustion drum 22 at opposite ends of the combustion drum 22, and the cylindrical bands 26 and 28 are positioned on rollers 30 and 32, respectively. The combustion drum 22 is rotated by any suitable drive arrangement. For example, at least one of the rollers 30 and 32 may be driven by a motor (not shown) to cause the combustion drum 22 to rotate at a relatively slow rate (e.g., in the range of 1.5 to 3 rpm). Alternatively, rollers 30 and 32 may be freely rotating rollers and the combustion drum 22 may be driven through a gear drive arrangement.

Solid waste 34 is fed into a waste receiving end 36 of the combustion drum 22. As the combustion drum 22 is rotated, the waste material 34 travels from the waste receiving end 36 to a waste exit end 38. As the waste material 34 is transported from the waste receiving end 36 to the waste exit end 38, combustion fluid (e.g., air) is provided to the interior of the combustion drum 22 via a combustion fluid supply means 40 to cause burning of the waste material 34. It should be noted that when the rotary combustor 20 is initially started up, an auxiliary fuel is employed to ignite the initial batch of waste material 34. The combustion fluid supply means 40 supplies combustion air under pressure from a blower (not shown) and includes an air duct 42 and three combustion fluid supply zones 44. Each of the combustion fluid supply zones includes control ducts 46 and 48, wherein the control ducts 46 and 48 are employed to supply combustion air to two windboxes (described below) which are included in each of the combustion fluid supply zones 44. The combustion fluid supply zones 44 are separated from each other by division plates 50 to maintain a fluid seal between the combustion fluid supply zones 44.

In order to prevent damage to the rotary combustor 20 due to high temperatures, the combustion drum 22 is cooled by the tubes 24 via a heat exchange fluid which is supplied to the tubes 24 via supply pipes 56 and 57. The supply pipe 57 is coupled to a joint 58 which serves as a rotary coupler for the supply pipe 57, so that heat exchange fluid can be supplied to and from the combustion drum 22 while the combustion drum 22 is being rotated. A pump 60 is connected to the joint 58 via supply pipes 62, and is also connected to a heat exchanger 64 via supply pipes 66. Thus, the heat exchange fluid which is heated by the heat from the burning of the waste material 34, is supplied to the heat exchanger 64 which extracts the heat for purposes of generating electricity, thereby reducing the temperature of the heat exchange fluid before it is returned to the tubes 24 of the combustion drum 22 via the pump 60, the joint 58 and the supply pipes 66, 62, 57 and 56. The heat exchanger 64 may be a steam turbine for generating electricity. At the waste exit end 38 of the combustion drum 22, solid combustion products 52 and exhaust gases 54 are discharged. The heat extracted from the heat exchanger 64 may be supplemented by the heat from the exhaust gases 54 which travel up a flue 68 positioned over the waste exit end 38 of the combustion drum 22.

Referring to FIG. 2 which is a schematic cross-section of FIG. 1A taken along line 2—2, windboxes 70 and 72 which provide 450° F. combustion air to the rotary combustor 20 in one of the combustion fluid supply zones 44, are illustrated. As illustrated in FIG. 2, the combustion drum 22 is a rotatable cylindrical drum which is rotated in the direction of the arrow W in FIG. 2. Further, as the combustion drum 22 is rotated, all of the waste material 34 is shifted to one side of the drum as it travels from the waste receiving end 36 to the waste exit end 38 of the combustion drum 22. The combustion drum 22 is formed by welding perforated steel plates 73 in between the tubes 24. The perforations in the plates 73 allow the combustion air to be blown into the interior of the combustion drum 22. Windbox 70 provides overfire combustion air through the perforations to the interior of the combustion drum 22 in the direction of arrow X in FIG. 2, while windbox 72 provides underfire combustion air through the perforations to the interior of the combustion drum 22 in the direction of arrow Y in FIG. 2. It has been determined that the provision of both underfire and overfire combustion air results in the most complete combustion of the waste material 34. The windboxes 70 and 72 provide separate air passages so that combustion air is provided at predetermined portions along the periphery of the combustion drum 22, as the combustion drum 22 is rotated. The means for defining these passages (by providing a fluid seal at the periphery of the rotating combustion drum 22) includes axial seals 74 which extend from the tubes 24 along the outer periphery of the combustion drum 22. Dividers 76 define the windboxes 70 and 72, and extending from each of the dividers 76 is a T-shaped rigid shoe 78 which is positioned adjacent the periphery of the combustion drum 22, so that the axial seals 74 contact the rigid shoe 78 as the axial seals 74 are rotated past the rigid shoe 78. As a result, gross air seals are provided for the windboxes 70 and 72.

While currently available axial seal systems such as that depicted in FIG. 2, are capable of providing sufficient air seals for the windboxes 70 and 72, these systems require final adjustment of the axial seals 74 in the field and are difficult to assemble and to adjust to provide an adequate seal. That is, the position of each of the axial seals 74 must be adjusted to ensure an adequate seal when the axial seal 74 is rotated past the rigid shoe 78. A typical axial seal 74 will have 15 to 20 nuts and bolts which must be adjusted and tightened in the field. Thus, a typical rotary combustor 20 will have 2,000 or more nuts and bolts to adjust and tighten once the axial seals 74 are positioned in place.

In addition to the above-described problem presented by the required field adjustments, is the related problem of thermal growth of the rotary combustor 20 in the radial direction. That is, because the combustion drum 22 will tend to expand and contract with temperature, the axial seal 74 may not contact the rigid shoe 78 (in which case no seal is provided) or the axial seal 74 may be bent and damaged by the rigid shoe 78 if too large a portion of the axial seal 74 comes in contact with the rigid shoe 78. As a result, proper adjustment of the axial seal 74 requires consideration of the radial expansion and contraction of the combustion drum 22, making the proper adjustment of the axial seal 74 even more difficult. Thus, there is a need in the art for an improved axial seal system which is simple to install and which compensates for thermal expansion and contraction in the radial direction by the combustion drum 22.

SUMMARY OF THE INVENTION

It is an object of the present invention to provide an axial seal system for a rotary combustor, which overcomes the deficiencies of prior art seal systems.

In particular, it is an object of the present invention to provide an axial seal system which is simple to install and which compensates for thermal growth of the rotary combustor as a result of the high temperatures employed in the rotary combustor.

It is a further object of the present invention to provide an axial seal system for a rotary combustor, which has relatively few parts and requires litle maintenance.

The rotary combustor of the present invention comprises a rotatable cylindrical drum having axial seals extending from the outer periphery thereof, and means for defining a plurality of passages for providing combustion fluid to portions along the outer periphery of the rotatable cylindrical drum. The means for defining a plurality of passages includes a plurality of means for resiliently engaging the axial seals as the rotatable cylindrical drum is rotated, so that when two of the axial seals come into contact with a respective pair of the resilient engaging means, a passage for providing combustion fluid to a portion of the periphery of the rotatable cylindrical drum is formed.

In the preferred embodiment, each of the resilient engaging means comprises a movable shoe positioned along one portion of the periphery of the rotatable cylindrical drum, and means for biasing the movable shoe so as to urge the movable shoe into contact with at least one axial seal. The biasing means includes a support positioned at a predetermined distance from the axial seals along one portion of the outer periphery of the rotatable cylindrical drum, and two spring units for urging the movable shoe into contact with the at least one axial seal.

According to the present invention, it is not necessary to provide adjustable axial seals, and the axial seals can instead be permanently affixed to the tubes which make up the rotatable cylindrical drum, thereby avoiding the requirement of having numerous nuts and bolts which must be tightened and adjusted after positioning the axial seals in place. Further, because the movable shoe which contacts the axial seals is spring biased, it is ensured that the axial seal strips will contact the movable shoe to provide the necessary air seal, even though the position of the axial seals will vary with the thermal expansion and contraction of the rotatable cylindrical drum. Further, because the movable shoe is resiliently held in place, if the rotatable cylindrical drum expands, the axial seals will not be bent or damaged. Thus, the axial seal system of the present invention is a low maintenance system having relatively few parts and minimal field installation requirements compared to current axial seal systems. Further, replacement of any parts can be carried out quickly and easily.

These together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1A:
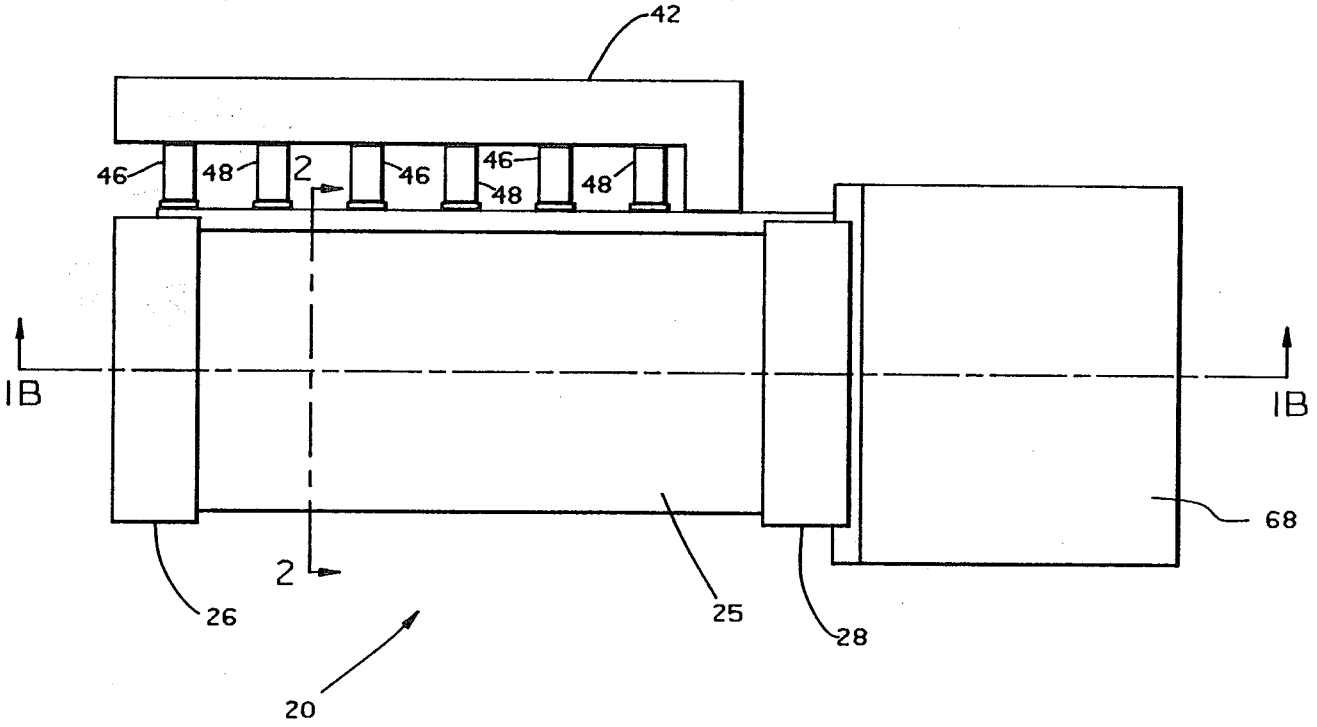
FIG. 1A s a schematic plan view of a rotary combustor.
Figure 1B:
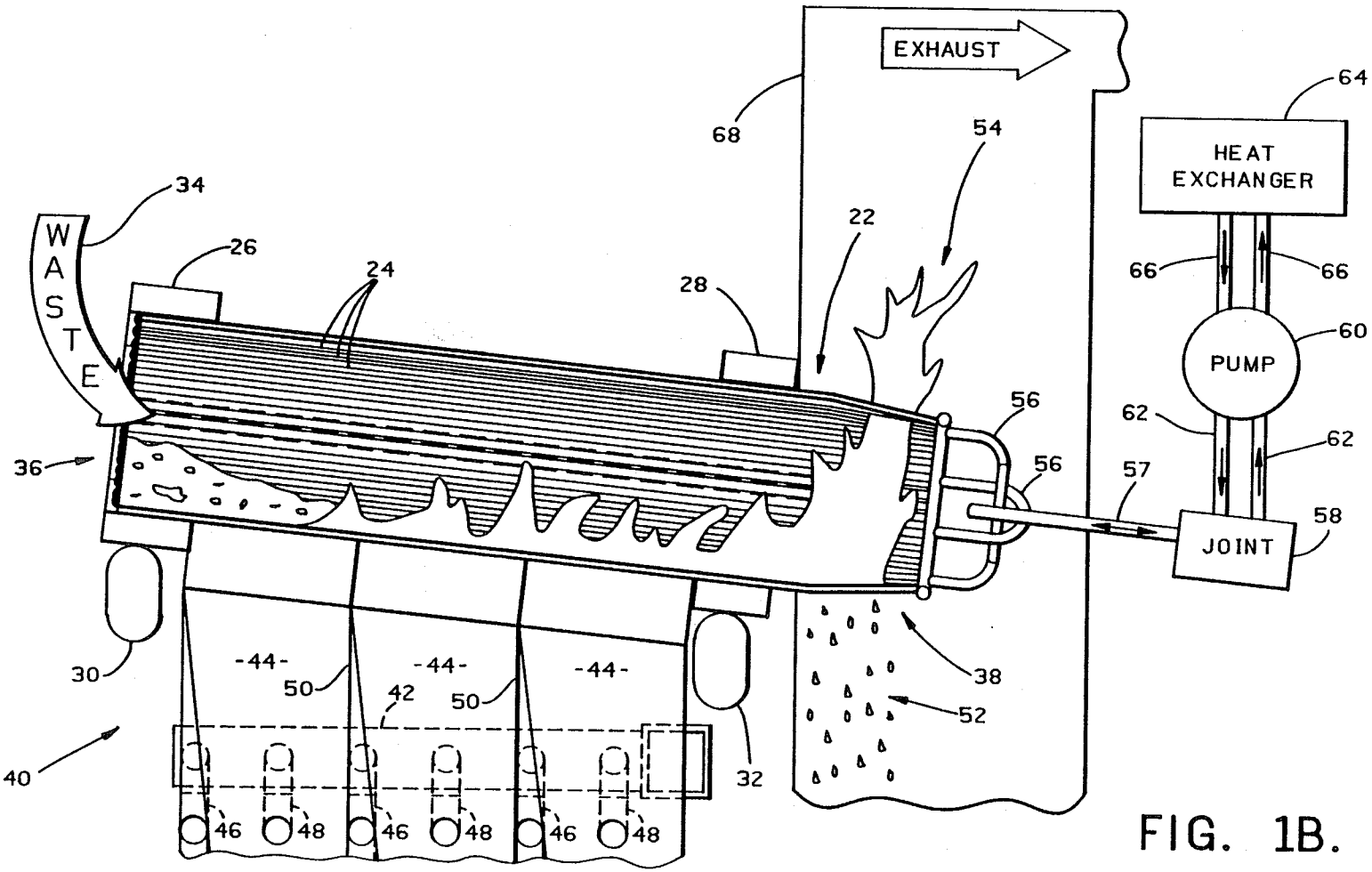
FIG. 1B is a schematic cross-sectional view of the rotary combustor of FIG. 1B, taken along line B—B of FIG. 1A with the outer casing removed and showing the connection of the rotary combustor to a heat exchanger and heat exchange fluid supply apparatus.
Figure 2:
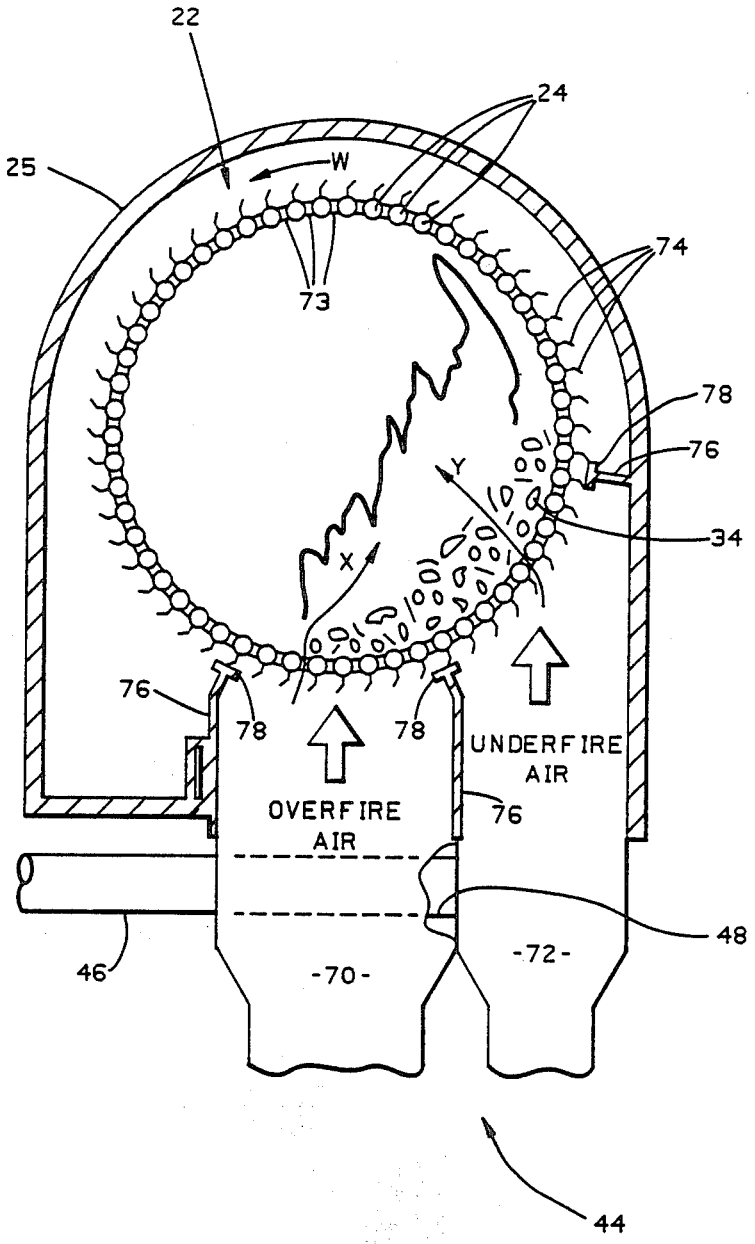
FIG. 2 is a schematic cross-sectional view of the rotary combustor of FIG. 1A, taken along line 2—2 of FIG. 1A.
Figure 3:
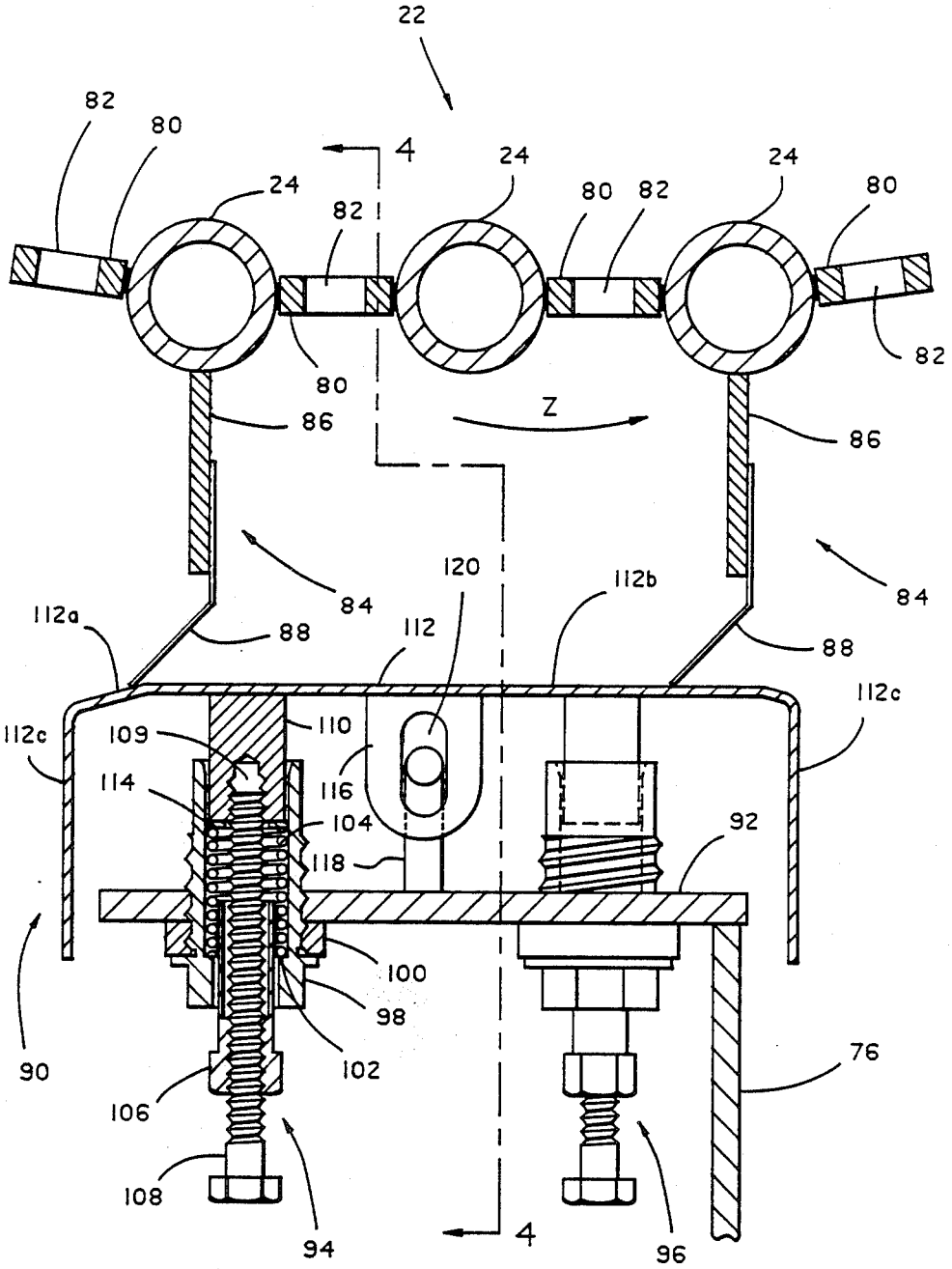
FIG. 3 is an enlarged fragmentary sectional view of a portion of the combustion drum 22 and the arrangement of the axial seal system of the present invention as it is employed with the rotary combustor of FIG. 2.
Figure 4:
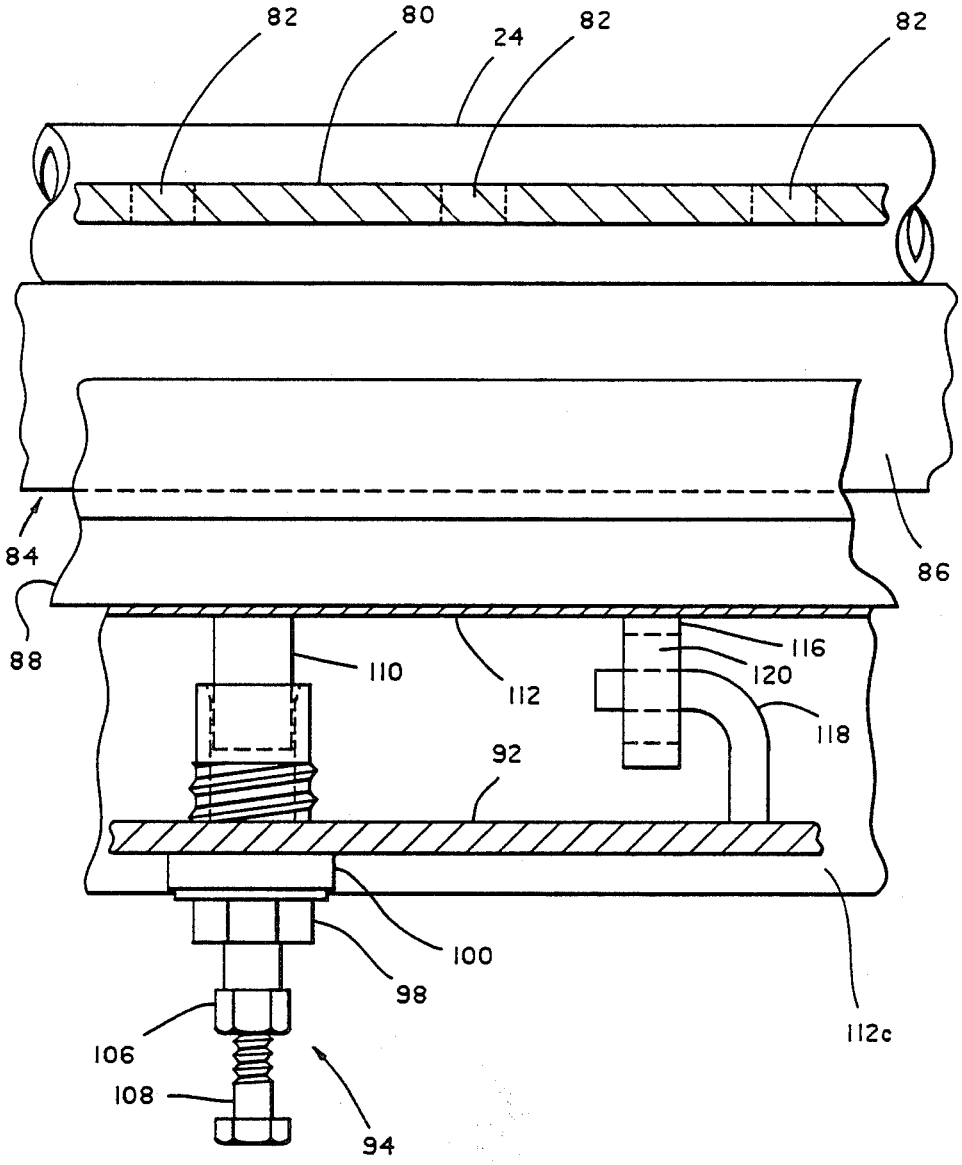
FIG. 4 is a cross-sectional view taken alone line 4—4 in FIG. 3.

An embodiment of the present invention will be described with reference to FIGS. 3 and 4. The combustion drum 22 includes tubes 24 for carrying the heat exchange fluid, and the tubes 24 are welded to steel sheets 80 having perforations 82, which are arranged between the tubes 24. As described above, the perforations 82 provide a path for the combustion air. In the axial seal system of the present invention, the adjustable axial seals 74 of FIG. 2 are replaced by axial seals 84 extending from every other tube 24, wherein each of the axial seals 84 includes a seal support 86 and an axial seal strip 88. In the preferred embodiment, each seal support 86 is tack welded to the corresponding tube 24 and each axial seal strip 88 is welded to the corresponding seal support 86. Further, in the preferred embodiment, each axial seal strip 88 is formed by ⅛ inch carbon steel and has an angled shape, so that the axial seal strip 88 is flexible. In the present invention, the rigid shoes 78 of FIG. 2 are replaced by sealing structures 90 (only one of which is shown in FIG. 3). The axial seal system of the present invention is formed by the axial seals 84 and the sealing structures 90 which form a means for resiliently engaging the axial seals 84 as the combustion drum 22 is rotated, so that when one of the axial seals 84 comes into contact with one of the sealing structures 90, an air seal is formed along the area of contact.

Each sealing structure 90 includes a divider 76 similar to the divider 76 in FIG. 2, and a bottom plate 92 which is welded to (and held stationary by) the divider 76. A pair of spring units 94 and 96 are coupled to the bottom plate 92 and serve as biasing means. Since the spring units 94 and 96 are identical, only the spring unit 94 will be described in detail. Spring unit 94 includes a spring housing 98 which is threaded through a hole in the bottom plate 92 and which is adjustably positioned with respect to the bottom plate 92 by an offset plate 100. The spring housing 98 has an internal abutment 102 and has a cylindrical opening formed therein for holding a spring 104. An adjustable guide and stop 106 and a retaining bolt 108 are inserted through the spring housing 98 and through the middle of the spring 104. The retaining bolt 108 is adapted to be threaded through the adjustable guide and stop 106 into a threaded hole 109 provided in a bar 110 which is welded to the bottom of a movable shoe 112. A washer 114 is positioned on one end of the bar 110 adjacent the threaded hole, so that when the retaining bolt 108 is screwed into the threaded hole 109 of the bar 110, the spring 104 is held between the internal abutment 102 of the spring housing 98 and the washer 114. The movable shoe 112 is provided with an inclined surface **112*a* and a top surface 112*b*, so that as the combustion drum 22 is rotated in the direction of the arrow Z in FIG. 3, each axial seal strip 88 will initially contact the inclined surface 112*a* of the movable shoe 112 to create an air seal and will slide along (i.e. wipe) the inclined surface 112*a* until reaching the top surface 112*b* of the movable shoe 112. The air seal is maintained as the axial seal strip slides along the top surface 112*b*. By providing the inclined surface 112*a*, the initial contact force applied to the axial seal strip 88 is reduced, so that the possibility of damage to the axial seal strip 88 (e.g., due to bending) is reduced. The movable shoe 112 is also provided with sidewalls 112*c* which are sufficiently long to maintain a gross air seal and to protect the spring units 94 and 96 from damage due to combustion products which might fall from the combustion drum 22. Since the axial seals 84 are permanently positioned with respect to the tubes 24, if the combustion drum 22 expands or contracts due to temperature, the position of the axial seals 84 with respect to the rigidly held bottom plate 92 will vary. However, because the spring units 94 and 96 support the movable shoe 112, the movable shoe 112 resiliently engages the axial seal strips 88 of the axial seals 84, and the position of the movable shoe 112 (with respect to the bottom plate 92) when it engages one of the axial seals 84 will vary with the expansion and contraction of the combustion drum 22**.

The sealing structure 90 also includes a bracket 116 which is welded to the bottom of the movable shoe 112 and a shoe guide 118 which is welded to the bottom plate 92 in between the spring units 94 and 96. The shoe guide 118 is an L-shaped member and extends through an aperture 120 in the bracket 116 (see FIG. 4), so that the movable shoe 112 is pivoted about the shoe guide 118 as each axial seal 84 initially engages the inclined surface **112*a* of movable shoe 112, moves across the top surface 112*b* of the movable shoe 112 and disengages the movable shoe 112. It should be noted that the components of the sealing structure 90 are formed of materials which are sufficiently heat resistant to allow for their use in the environment of the rotary combustor 20. For example, structural elements such as the movable shoe 112, the bottom plate 92 and the dividers 76 are made of carbon steel. Similarly, the spring 104** is a high temperature, corrosion resistant spring which may be, for example, a model MP35NC Duer's spring manufactured by Duer Spring Manufacturing Company of Coraopolis, Penna.

Referring to FIGS. 1B and 2–4, each of the combustion fluid supply zones 44 includes two windboxes 70 and 72. Thus, a total of three sealing structures 90 are positioned in each of the combustion fluid supply zones 44 for an overall total of nine sealing structures 90 for the rotary combustor 20. That is, each sealing structure 90 replaces one of the rigid shoes 78 illustrated in FIG. 2. However, in the preferred embodiment, each movable shoe is approximtely 3 feet long and one foot wide and has side edges (**112*c*) which extend approximately 7 to 8 inches. Since each movable shoe 112 is only approximtely 3 feet long, in practice, it is necessary to use two sealing structures 90, end-to-end, to replace each of the rigid shoes 78 illustrated in FIG. 2. This is because each zone is approximately 6 feet in length (for a total of 18 feet). Thus, each axial seal 84 is approximately 6 feet in length (i.e., one zone), so that a particular axial seal 84 will contact two side-by-side movable shoes 112 simultaneously as the axial seal 84** is rotated.

Referring to FIGS. 2 and 3, in operation, the axial seals 84 are rotated with the combustion drum 22 in a counterclockwise direction. As an axial seal 84 approaches a sealing structure 90, the axial seal strip 88 contacts the inclined surface **112*a* of the moveable shoe 112. Then, as the combustion drum 22 continues rotation, the axial seal strip 88 is wiped across the inclined surface 112*a* and the top surface 112*b* of the moveable shoe 112 until the axial seal strip 88 has travelled across the entire moveable shoe 112. Depending upon the position of the axial seal strip 88 on the movable shoe 112 (and depending upon whether one or two axial seal strips 88 are in contact with the movable shoe 112) the movable shoe 112 will pivot about the L-shaped shoe guide 118. When the axial seal strip 88 contacts the inclined surface 112*a* it begins to compress the spring units 94 and 96. That is, the bar 110 will be forced downward, compressing the spring 104 against the internal abutment 102 of the immovable spring housing 98 which is attached to the bottom plate 92. The spring 104 continues to be compressed further until the axial seal strip 88 reaches the top surface 112*b* of the moveable shoe 112, at which point the spring 104 is compressed to its fullest extent. After the axial seal strip 88 has completed its travel across the top surface 112*b* of the moveable shoe 112, the spring 104 and the moveable shoe 112 return to their normal positions. While the axial seal strip 88 is in contact with the moveable shoe 112, an air seal is provided along the axial seal 84, the moveable shoe 112 and the divider 76. It should be noted that in the embodiment illustrated in FIG. 3, the axial seals 84 are arranged such that two axial seals 84 are simultaneously in contact with the movable shoe 112. This ensures that at least one axial seal 84 is always in contact with a portion of the moveable shoe 112**, thereby providing a continuous air seal for the combustion air.

Although a preferred embodiment of the present invention has been described with respect to the drawings, it should be noted that the present invention can be implemented by any suitable type of means for resiliently engaging the axial seals 84 as the combustion drum 22 rotates, so that a sealed wall is formed for a combustion fluid passage. Although the invention has been described with reference to combustion air, any suitable type of combustion fluid may be employed. Further, although the sealing structure 90 and the axial seals 84 have been described as being formed of particular types of materials, it should be noted that the present invention may be implemented by using any type of material which is sufficiently heat resistant for use in the environment of the rotary combustor 20. In addition, although the rotary combustor 20 has been described as having tubes 24 which carry water, any suitable type of heat exchange fluid may be employed, and the heat which is extracted from the heat exchange fluid may be used for purposes other than generating electricity (e.g., for use as a heat source).

The many features and advantages of the present invention are apparent from the detailed specification, and thus it is intended by the appended claims to cover all such features and advantages of the system which fall within the true spirit and scope of the invention. Further, since numerous modifications and changes will readily occur to those skilled in the art, it is not desired to limit the invention to the exact construction and operation shown and described and, accordingly, all suitable modifications and equivalents may be resorted to, falling within the scope of the invention.

What is claimed is:

1. A rotary combustor comprising:

a rotatable cylindrical drum having axial seals extending from the outer periphery thereof; and means for forming a plurality of passages for providing combustion fluid to portions along the outer periphery of said rotatable cylindrical drum, said means for forming a plurality of passage including a plurality of means for resiliently engaging respective ones of said axial seals as said rotatable cylindrical drum is rotated, so that when two of said axial seals contact a respective pair of said resilient engaging means, a passage for providing combustion fluid to a portion of the periphery of said rotatable cylindrical drum between said two axial seals, is formed, each of said resilient engaging means including:

a movable shoe positioned along a portion of the outer periphery of said rotatable cylindrical drum; and means for biasing said movable shoe so that said movable shoe is urged into contact with at least one of said axial seals, said biasing means including:

a support positioned along a portion of the outer periphery of said rotatable by cylindrical drum at a predetermined distance from said axial seals; and spring means, coupled to said support and said movable shoe, for urging said movable shoe into contact with said at least one of said axial seals.

2. A rotary combustor according to claim 1, wherein:

said spring means comprises first and second spring units coupled between said support and said movable shoe; and said biasing means further comprises means for pivoting said movable shoe about a pivot point between said first and second spring units.

3. A rotary combustor according to claim 2, wherein each of said first and second spring units comprises:

a bar extending from said movable shoe, said bar having an end with a threaded hole tapped therein;

a spring housing coupled to said support and surrounding the end of said bar;

a spring positioned within said spring housing and substantially in contact with the end of said bar; and a retaining bolt, extending through said spring housing and said spring, for engaging the threaded hole in said bar.

4. A rotary combustor according to claim 3, wherein each of said first and second spring units further comprises an adjustable guide and stop extending through said spring housing and said spring, and being threaded so as to receive said retaining bolt.

5. A rotary combustor according to claim 3, wherein said spring is a high temperature, corrosion resistant spring.

6. A rotary combustor according to claim 1, wherein said rotatable cylindrical drum comprises:

a plurality of tubes arranged in a cylindrical shape and interconnected to provide a path for heat exchange fluid; and a plurality of perforated sheets alternately connected between said tubes.

7. A rotary combustor according to claim 6, wherein each of said axial seals comprises:

a seal support welded to a corresponding one of said tubes; and an angled axial seal strip welded to said seal support.

8. A rotary combustor according to claim 7, wherein said rotatable cylindrical drum receives waste material which is burned inside the rotatable cylindrical drum, further comprising a heat exchanger, coupled to said plurality of tubes, for removing from the heat exchange fluid, the heat which is caused by the combustion of the waste material.

9. A rotary combustor according to claim 1, wherein said respective pair of said resilient engaging means form a portion of a windbox, and wherein said rotary combustor further comprises means for providing the combustion fluid to said windbox.

10. A rotary combustor according to claim 9, wherein the combustion fluid is heated air.

11. A rotary combustor comprising:

a rotatable cylindrical drum having axial seals extending from the outer periphery thereof; and means for forming a plurality of passages for providing combustion fluid to portions along the outer periphery of said rotatable cylindrical drum, said means for forming a plurality of passage including a plurality of means for resiliently engaging respective ones of said axial seals as said rotatable cylindrical drum is rotated, so that when two of said axial seals contact a respective pair of said resilient engaging means, a passage for providing combustion fluid to a portion of the periphery of said rotatable cylindrical drum between said two axial seals, is formed, each of said resilient engaging means including:

a movable shoe positioned along a portion of the outer periphery of said rotatable cylindrical drum; and means for biasing said movable shoe so that said movable shoe is urged into contact with at least one of said axial seals, said movable shoe having a top surface, an inclined surface extending from the top surface, and sides extending from said inclined surface and said top surface, so that when said rotatable cylindrical drum is rotated, each of said axial seals will initially contact said inclined surface of said movable shoe.

12. An apparatus for providing a seal for a passage providing a combustion fluid to a portion of a rotatable cylindrical drum in a rotary combustor, the rotatable cylindrical drum having a plurality of axial seals extending from the outer periphery thereof, said apparatus comprising:

a movable shoe positioned along a portion of the outer periphery of the rotatable cylindrical drum; and means for biasing said movable shoe so that said movable shoe is urged into contact with at least one of the axial seals to provided a seal against the escape of the combustion fluid along the axial seal, said biasing means including:

a support positioned along a portion of the outer periphery of the rotatable cylindrical drum at a predetermined distance from the axial seals; and spring means, coupled to said support and said movable shoe, for urging said movable shoe into contact with the at least one of the axial seals.

13. An apparatus according to claim 12, wherein:

said spring means comprises first and second spring units coupled between said support and said movable shoe; and said biasing means further comprises means for pivoting said movable shoe about a pivot point between said first and second spring units.

14. An apparatus according to claim 13, wherein each of said first and second spring units comprises:

a bar extending from said movable shoe, said bar having an end with a threaded hole tapped therein;

a spring housing connected to said support and surrounding the end of said bar;

a spring positioned within said spring housing and substantially in contact with the end of said bar; and a retaining bolt, extending through said spring housing and said spring, for engaging the threaded hole in said bar.

15. An apparatus according to claim 14, wherein each of said first and second spring units further comprises an adjustable guide and stop extending through said spring housing and said spring and being threaded so as to receive said retaining bolt.

16. An apparatus according to claim 14, wherein said spring is a high temperature, corrosion resistant spring.

17. An apparatus for providing a seal for a passage providing a combustion fluid to a portion fluid to a portion of a rotatable cylindrical drum in a rotary combustor, the rotatable cylindrical drum having a plurality of axial seals extending from the outer periphery thereof, said apparatus comprising:

a movable shoe positioned along a portion of the outer periphery of the rotatable cylindrical drum; and means for biasing said movable shoe so that said movable shoe is urged into contact with at least one of the axial seals to provide a seal against the escape of the combustion fluid along the axial seal, said movable shoe having a top surace, an inclined surface extending from the top surface, and sides extending from said inclined surface and said top surfce, so that when the rotatable cylindrical drum is rotated, each of the axial seals will initially contact said inclined surface of said movable shoe.

* * * * *